US006722274B2

(12) United States Patent
Mietta

(10) Patent No.: US 6,722,274 B2
(45) Date of Patent: Apr. 20, 2004

(54) PNEUMATIC GRIPPER DESIGNED FOR PERFORMING A VARIABLE LOWERING MOVEMENT DEPENDING ON THE TENSIONING STROKE THEREOF

(76) Inventor: Marco Mietta, Via Milano 14, 22070 Appiano Gentile (COMO) (IT)

( * ) Notice: Subject to any disclaimer, the term of this patent is extended or adjusted under 35 U.S.C. 154(b) by 0 days.

(21) Appl. No.: 10/209,370

(22) Filed: Jul. 30, 2002

(65) Prior Publication Data

US 2003/0230208 A1 Dec. 18, 2003

(30) Foreign Application Priority Data

Jun. 12, 2002 (IT) ..... MI2002A1299

(51) Int. Cl.[7] ..... B05C 17/06; B41F 1/30

(52) U.S. Cl. ..... 101/127.1; 101/127; 101/408; 101/128; 101/128.1; 101/415.1

(58) Field of Search ..... 101/408, 127.1, 101/127, 128, 128.1, 415.1

(56) References Cited

U.S. PATENT DOCUMENTS

| | | | | |
|---|---|---|---|---|
| 3,414,994 | A | * 12/1968 | Jaccard | 38/102.9 |
| 4,442,772 | A | * 4/1984 | Bubley | 101/127.1 |
| 5,235,908 | A | * 8/1993 | Froelicher et al. | 101/127.1 |
| 5,480,133 | A | * 1/1996 | Motev et al. | 271/85 |
| 5,581,918 | A | * 12/1996 | Schilling et al. | 38/102.1 |
| 5,979,312 | A | * 11/1999 | Williams | 101/127 |
| 6,484,629 | B1 | * 11/2002 | Hoffman, Jr. et al. | 101/44 |

* cited by examiner

*Primary Examiner*—Andrew H. Hirshfeld
*Assistant Examiner*—Marvin P Crenshaw
(74) *Attorney, Agent, or Firm*—Hedman & Costigan, P.C

(57) ABSTRACT

A gripper for screen printing applications comprises a gripper body supporting a tensioning assembly comprising a gripping element designed for gripping the edge of a fabric to be tensioned on a frame, and a bottom abutment cam providing a variable lowering stroke based on a withdrawal tensioning stroke of the tensioning assembly.

2 Claims, 8 Drawing Sheets

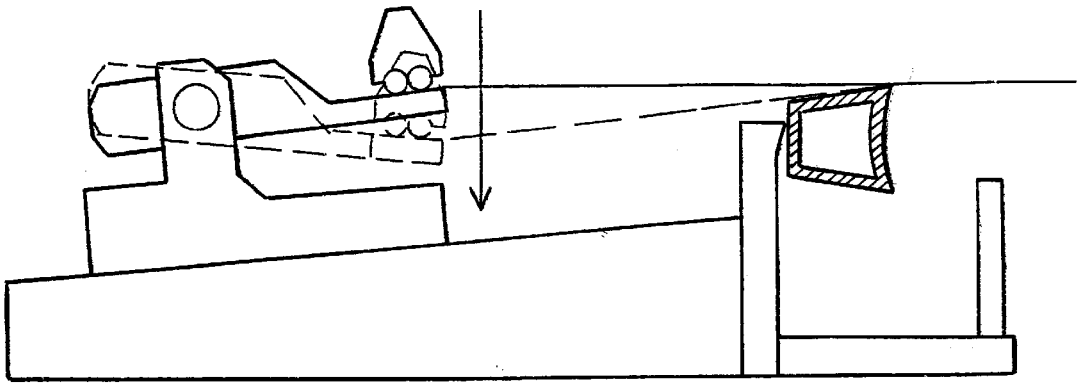
FIG. 10 PRIOR ART
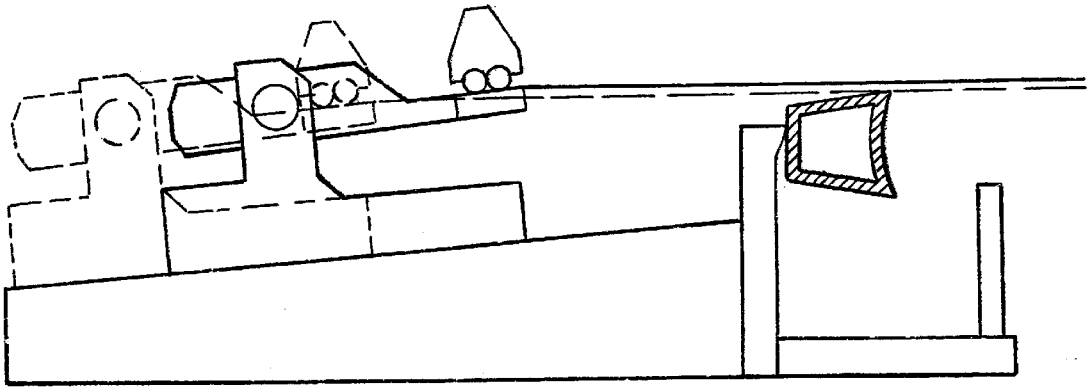
FIG. 11 PRIOR ART
FIG. 12 PRIOR ART
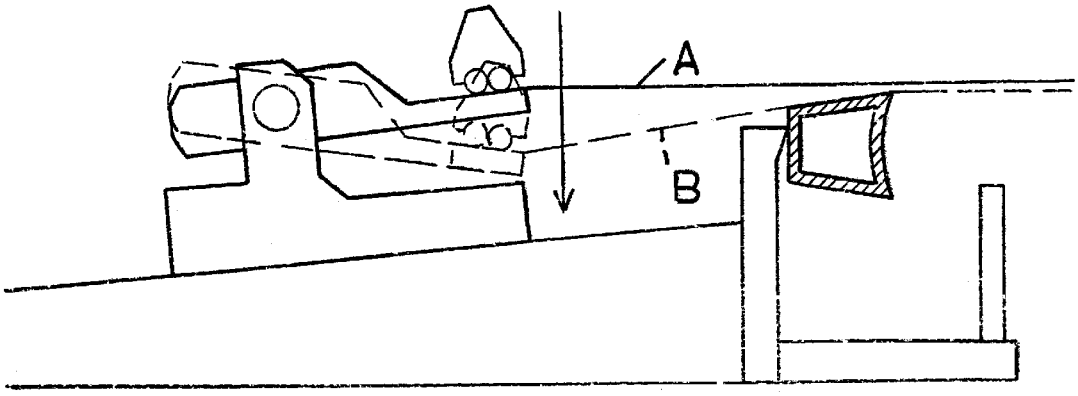

PNEUMATIC GRIPPER DESIGNED FOR PERFORMING A VARIABLE LOWERING MOVEMENT DEPENDING ON THE TENSIONING STROKE THEREOF

BACKGROUND OF THE INVENTION

The present invention relates to a pneumatic gripper for screen printing applications, adapted to perform a variable lowering movement, depending on a tensioning stroke thereof.

As is known, for making screen printing operations on fabric materials, the fabric material must be properly tensioned before glueing it to the printing frame.

To that end are used several different apparatus which can be substantially divided into silk tensioning devices and pneumatic grippers.

A silk tensioning apparatus usually comprises a fixed system for tensioning or stretching the fabric material to the desired printing patterns.

Such an apparatus, which mechanically operates, conventionally comprises electric motors, screws and guides, and a plurality of side rubber coated grippers for gripping the fabric material.

The side portions of the apparatus are driven parallel with respect to one another, in order to apply an even deformation to the fabric material and properly stretch it.

The pneumatic grippers, on the other hand, are hand-held tools, having gripping jaws with a width of substantially 15–30 cm designed to grip the fabric material and arrange it about the frame of the screen printing assembly.

The grippers are pneumatically driven and apply to the fabric a set tension level, without deforming it.

The grippers, which are not coupled to one another, can be properly arranged re-combined during the tensioning operation to fit to the screening frame size.

The main advantages of the pneumatic grippers are their very simple construction and low cost.

Said pneumatic grippers, in particular, can be further divided into single movement or effect grippers and dual-movement grippers.

The single movement grippers can be displaced only on a single surface of the fabric material.

Said grippers are very simple construction-wise, but have the drawback that the fabric material contacts the screen printing frame at the start of the operation, while during the stretching operation, the fabric is caused to slide on the screen-printing frame.

The dual-movement grippes, on the other hand, are comparatively complex construction-wise, and stretch the fabric by holding it raised from the screen printing frame, to cause said fabric material to contact the screen printing frame after a further independent lowering displacement.

Typically, both the above disclosed movements are performed pneumatically.

As is further known, a screen printing gripper must usually operate on a lot of different fabric materials of very different elongation and strength characteristics.

Moreover, to the above it is to be further added that pneumatic grippers are not stopped at their end of stroke positions, but only as the desired tension of the fabric being processed has been achieved.

The fabric tension or stretching values are typically included in a range from 20 to 60 N/cm, and the maximum width operating strokes of the grippers are of substantially 100–150 mm.

From an operation standpoint, a dual-movement gripper must meet different requirements which will be thereinbelow illustrated.

At first, it is necessary to protect the gripper from performing overturning movements.

In fact the overturning torque determined by the tensioning force, due to the level difference between the fabric material plane and screen printing frame, is balanced by a stabilizing torque of the weight force with respect to the front end portion of the fabric.

Because of practical weight and length limitations, and upon having set the designed fabric material tension or stretch value, the distance between the fabric material and screen printing frame planes cannot exceed a set limit (typically 15–20 mm), which affects, in a same degree, several operating parameters.

Different screen printing frames have a tapering cross-section and, accordingly, the fabric material lowering movement must be amplified to cause the fabric to properly bear on the top inclined face of the screen frame, to allow the fabric material to be suitably glued through the overall engaged width thereof.

In some cases, a slightly downward directed pulling movement is selected, to facilitate a proper bearing of the fabric material and reduce to suitable values the lowering operating stroke.

The value of the angle on the cross-sections of typically used screen printing frames is smaller than 6–7°.

The gripper, as it is lowered, must be able of inclining the fabric material with at least the mentioned angle; otherwise, the fabric material would be supported in an unproper manner, as schematically shown in FIG. 10.

The lowering operating stroke, has, in conventional grippers, a substantially constant value.

This feature, together with comparatively high tensioning strokes, would necessarily involve limited lowering angles and a consequent unproper bearing of the fabric material.

Due to the limitations on the distance of the fabric from the screen printing frame (for preventing any overturning from occurring), and since, to favor a proper bearing, an inclined lowering movement is frequently adopted, it can occur that, as a gripper is withdrawn, the fabric material contacts the screen printing frame, thereby causing uneven tension forces, deriving from friction.

Moreover, in a case of a worn screen printing frame, or a screen printing frame with glue residue therein, the fabric material could be undesirably broken.

This problem frequently occurs in grippers having a comparatively long operating stroke.

FIG. 11 schematically illustrates an anomalous contact between the fabric material and screen printing frame.

During the screen printing operation, the tension force is usually calibrat6ed by directly measuring the fabric material by a suitable measuring instruments (the so-called "tensiometer").

Upon having achieved the proper operating tension, the fabric material is lowered with a very high speed, without any possibility of correcting the end tension.

Accordingly, it is important that the lowering movement does not generate anomalous tension variations in the fabric material.

In actual practice, this means that the fabric portion between the gripper jaws and screen printing frame must be held at the same length both at the top or up position, schematically indicated by A in FIG. 12, and in the bottom or down position, schematically indicated by B in FIG. 12.

Since the fabric material has a substantially elastic nature, to equal deformations equal efforts or strain would correspond, thereby holding the applied tension.

The above disclosed three requirements must meet contrasting needs which, for high performance grippers (50–60 N/cm, and a stroke >100 mm) do not allow designing tolerances for the designed.

In fact, to obtain a good bearing of the fabric, it is necessary to incline with a very great inclined angle the fabric during the tensioning movement thereof.

However, this would require, to prevent any anomalous contacts between the fabric and screen printing frame, to greatly increase the starting distance between the fabric and screen printing frame, which would be impossible in order not to cause the gripper to loose its stability properties.

Since all the available screen printing grippers carry out a constant-stroke lowering movement, or a decreasing stroke as the gripper jaws (i.e. the rear hinged swinging portion) are withdrawn it could be stated that for said gripper exit maximum limit tensioning stroke, beyond which the operation of the grippers would become uneven.

SUMMARY OF THE INVENTION

Accordingly, the aim of the present invention is to provide such a gripper which overcomes the above mentioned problems.

Within the scope of the above mentioned aim, a main object of the present invention is to provide such a screen printing pneumatic gripper, of a dual-movement type, having an uneven (i.e. variable) lowering stroke, and designed for assuming higher values for greater tensioning strokes, thereby allowing the fabric material to be lowered with an angle sufficient to allow, in all operating cases, the fabric material to be properly supported, even on tapering cross-section frames.

Another object of the present invention is to provide such a gripper which can be industrially made with a simplified series production.

According to one aspect of the present invention, the above mentioned aim and objects, as well as yet other objects, which will become more apparent hereinafter, are achieved by a screen printing gripper comprising a screen printing gripper body supporting a gripping assembly supporting, in turn, a gripping element to grip an edge portion of a fabric material to be tensioned on a frame, characterized in that said screen printing gripper further comprises a bottom abutment cam designed for following a variable lowering stroke depending on a withdrawn stroke of the gripping element, to provide a variable lowering movement varying depending on a tensioning stroke of said fabric material.

BRIEF DESCRIPTION OF THE DRAWINGS

Further characteristics and advantages of the present invention will become more apparent hereinafter from the following detailed disclosure of a preferred, though not exclusive, embodiment of the invention which is illustrated, by way of an indicative, but not limitative example, in the accompanying drawings, where:

FIG. 2 is a side elevation view, as partially broken away, of the gripper according to the invention, illustrating the driving mechanism of the gripper and the smallest frame and largest frame the gripper can be fitted to;

FIGS. 10, 11 and 12 are further schematic diagrams of grippers according to the prior art, showing the above disclosed drawbacks.

DESCRIPTION OF THE PREFERRED EMBODIMENTS

Figure 1:
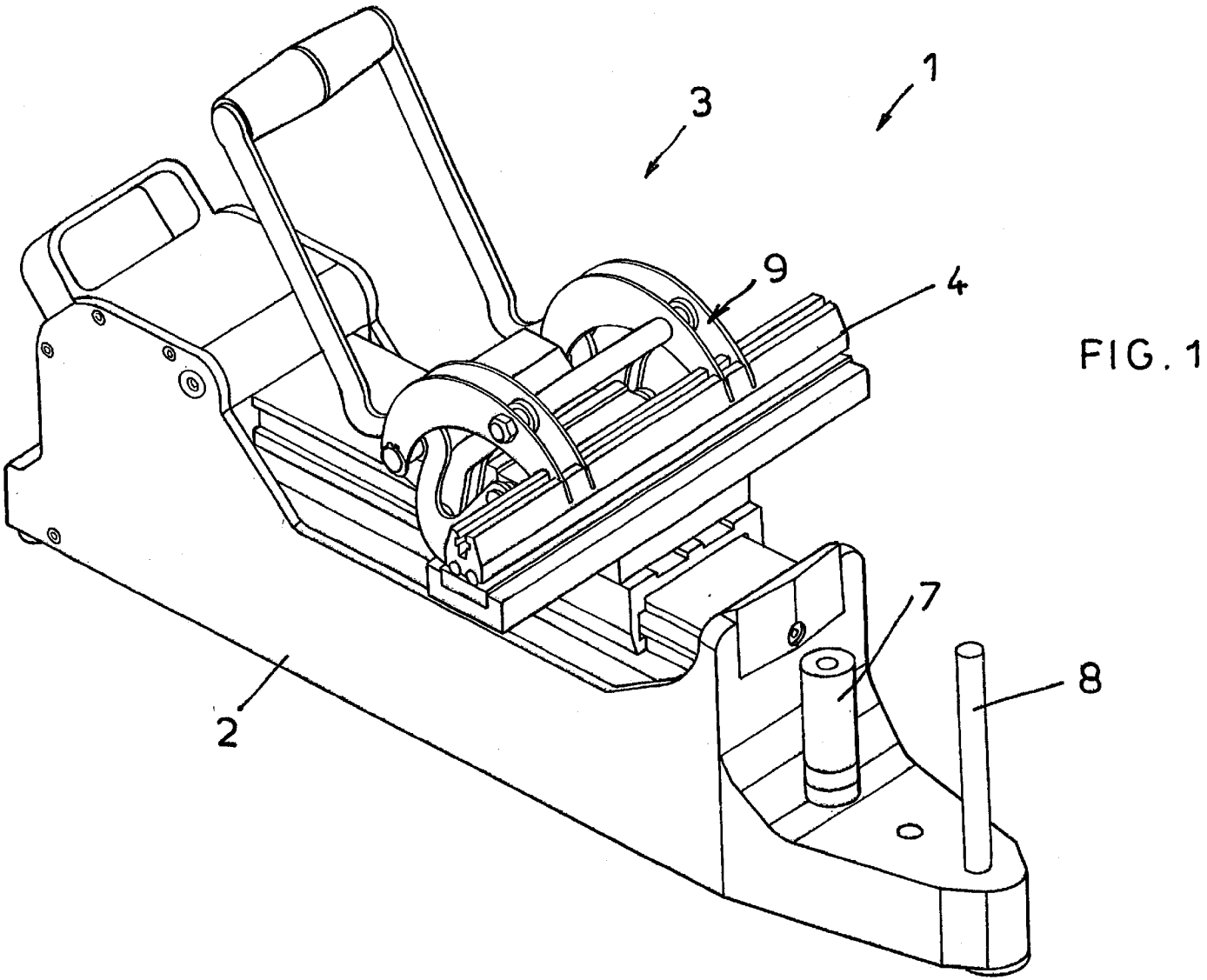
FIG. 1 is a perspective view of a gripper according to the present invention.

With reference to the number references of the above mentioned figures, the gripper according to the present invention, which has been generally indicated by the reference number 1, comprises a supporting body 2 supporting a gripping assembly 3, including a gripping element 4, designed for gripping an edge portion of a fabric material 5 to be tensioned or stretched on a screen-printing frame 6.

More specifically, the supporting body 2 comprises a supporting element 7 for supporting the frame 6, and a limit pivot 8, designed for operating as a safety element.

The gripper assembly 3 comprises, in turn, a linkage or lever assembly 9, which can be manually operated.

The pneumatic device 10 allows the gripping or tensioning assembly 3 to be lowered, during the lowering operating step of the gripper, by using a suitably designed mechanism 13.

According to the present invention, the gripper comprises a cam 11, operating as an end of stroke abutment element for a bearing foot element 12, rigid with said tensioning assembly 3.

Figure 2:
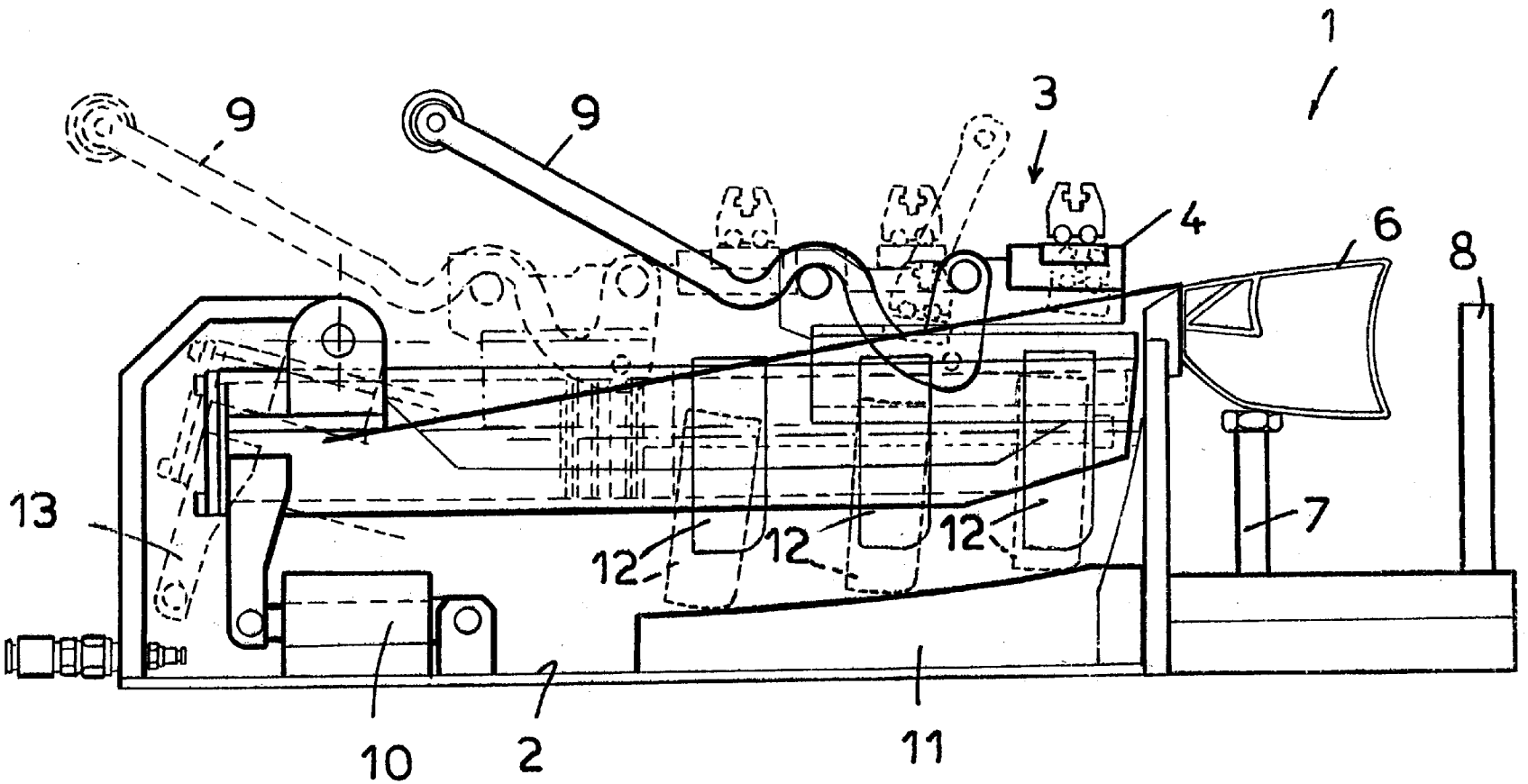
Figure 3:
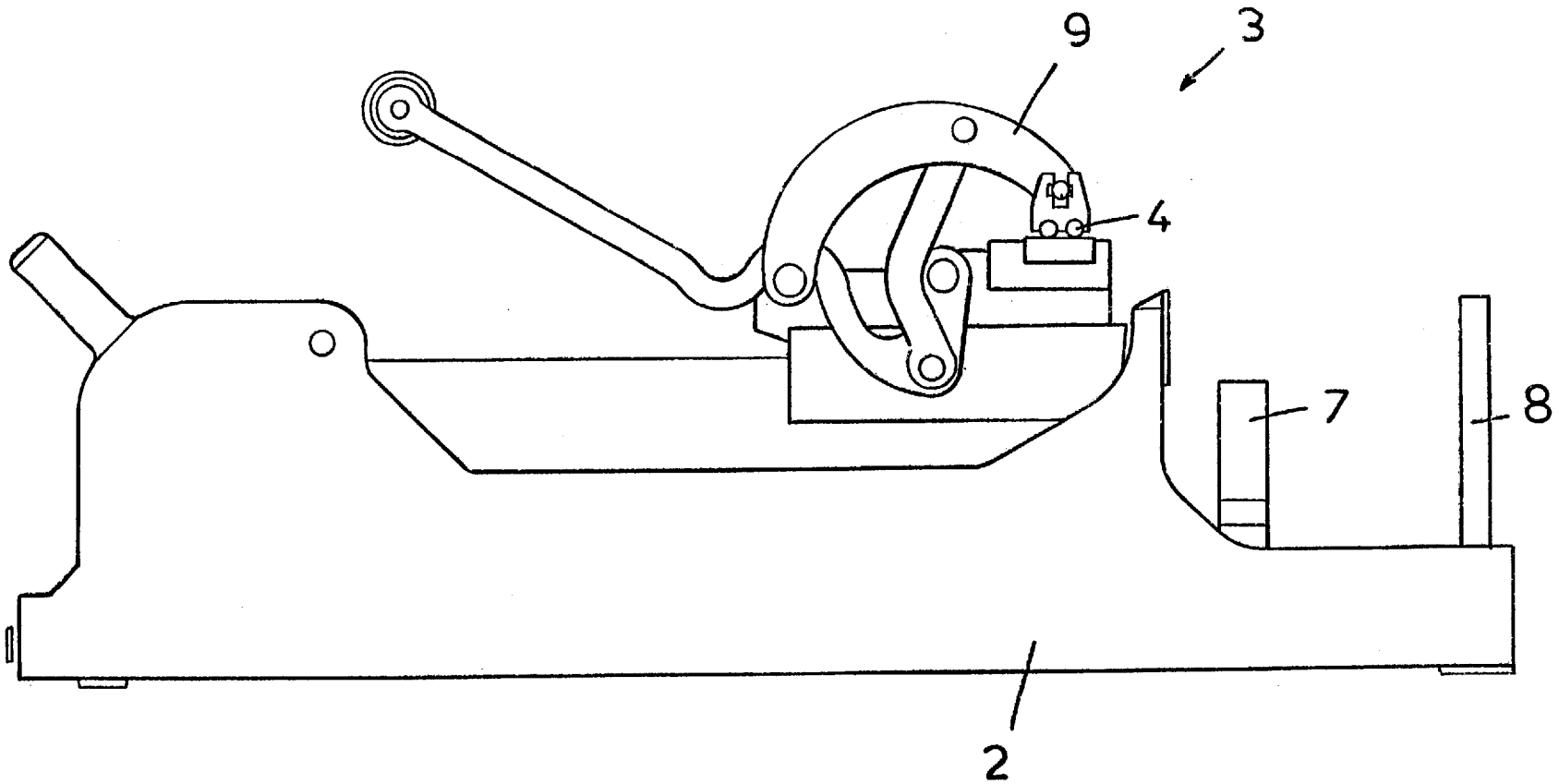
FIG. 3 is a further side elevation view of the gripper according to the invention.
Figure 4:
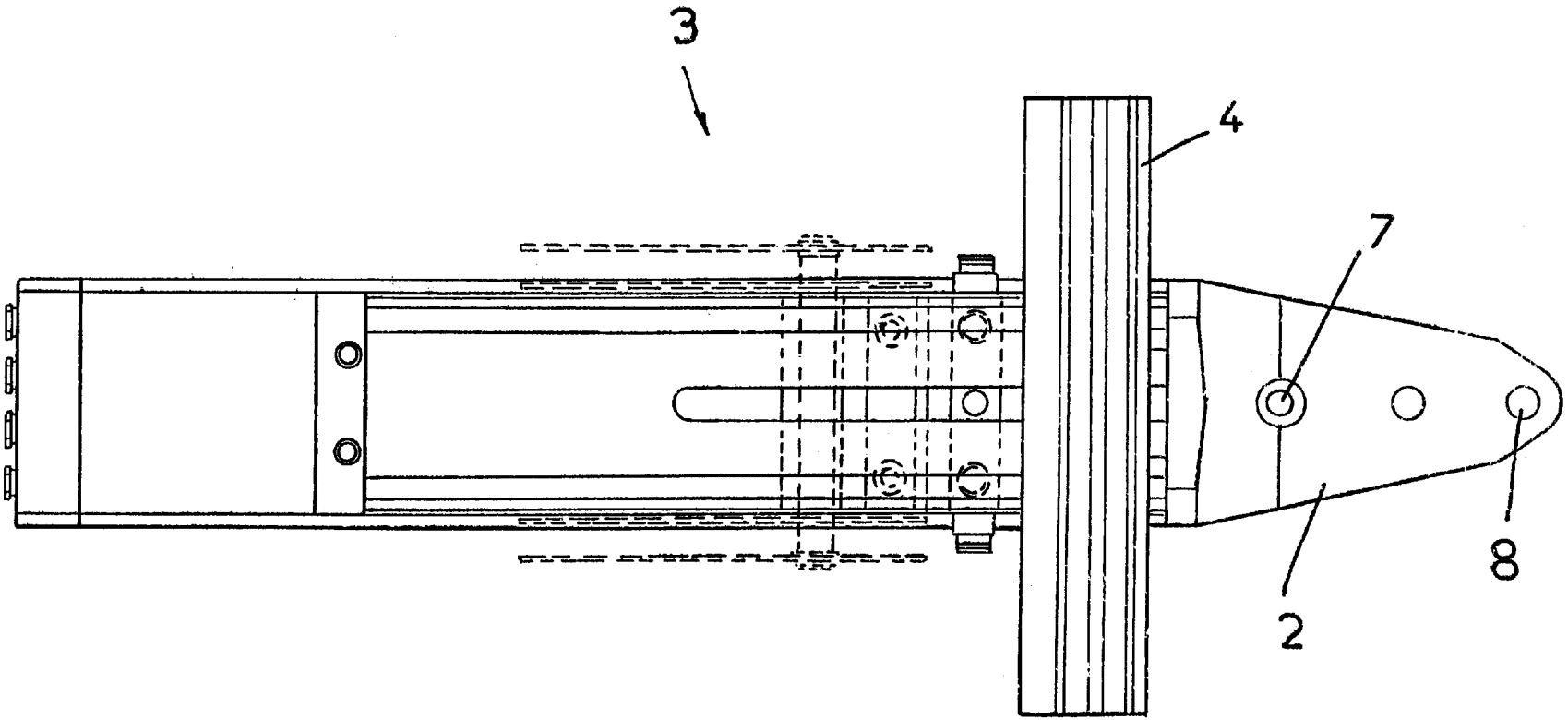
FIG. 4 is a top plan view of the gripper according to the invention.
Figure 6:
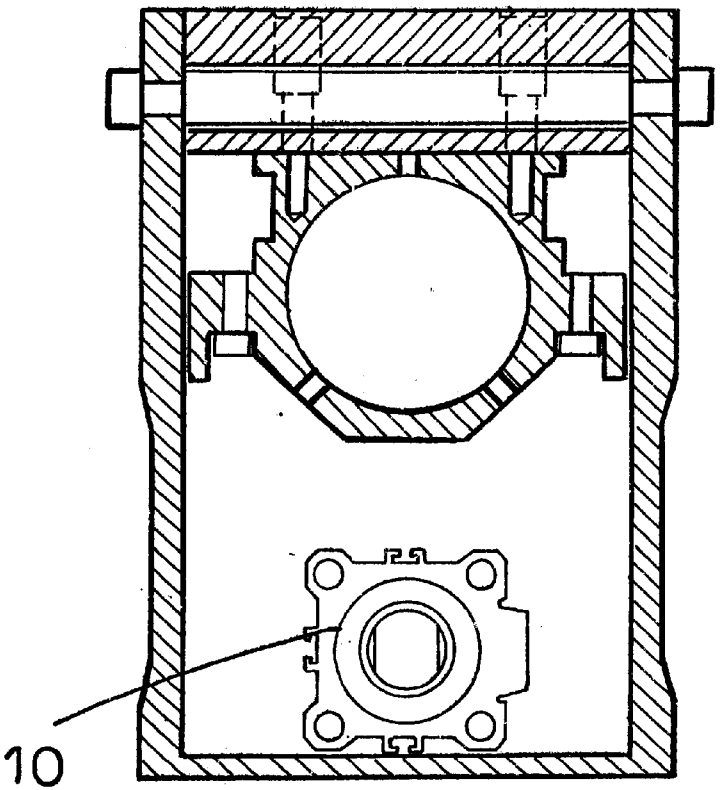
FIGS. 5, 6 and 7 are cross-sectional views, taken through different section planes, of the gripper according to the present invention.
Figure 5:
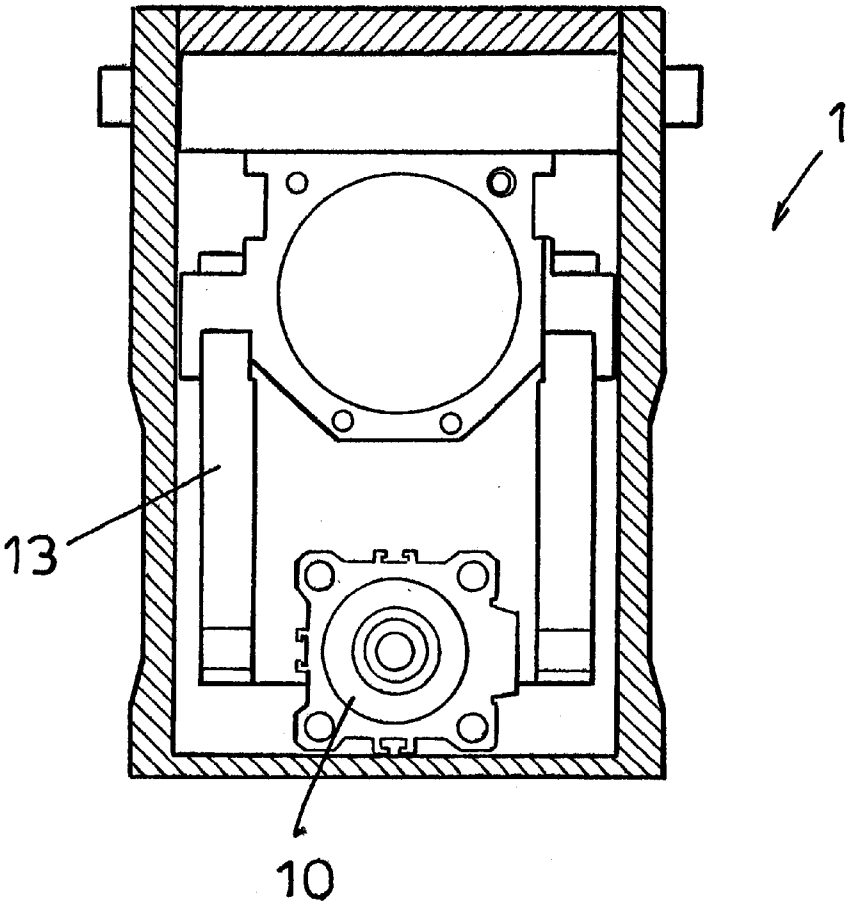
Figure 7:
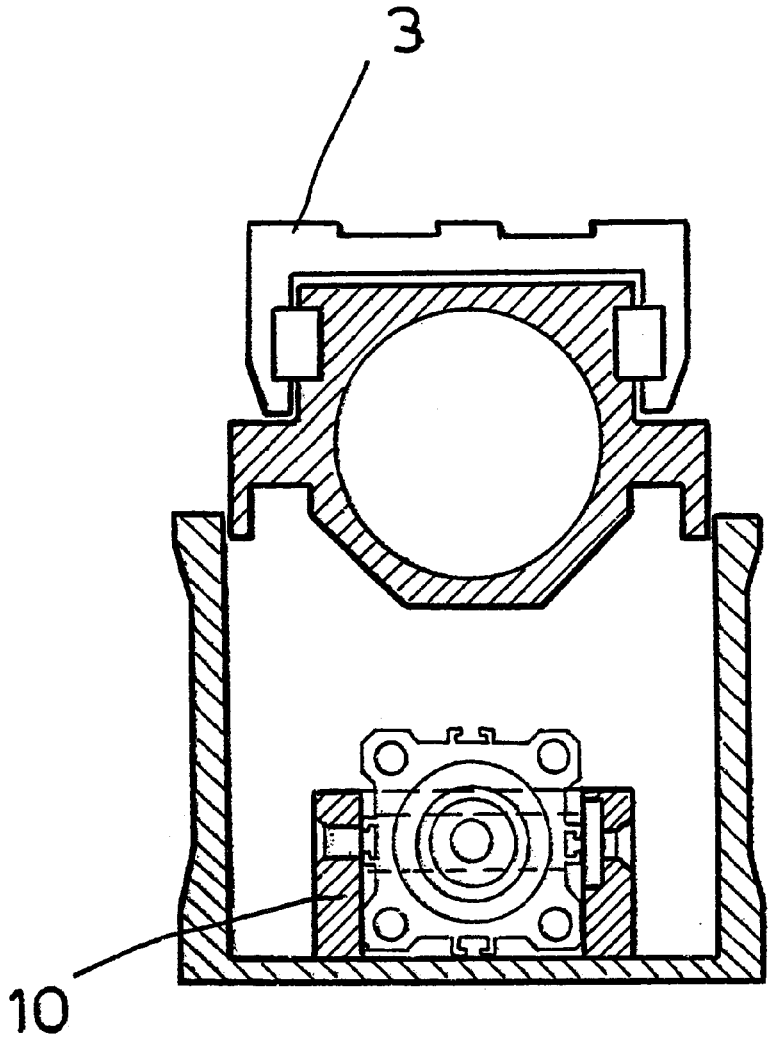
Figure 8:
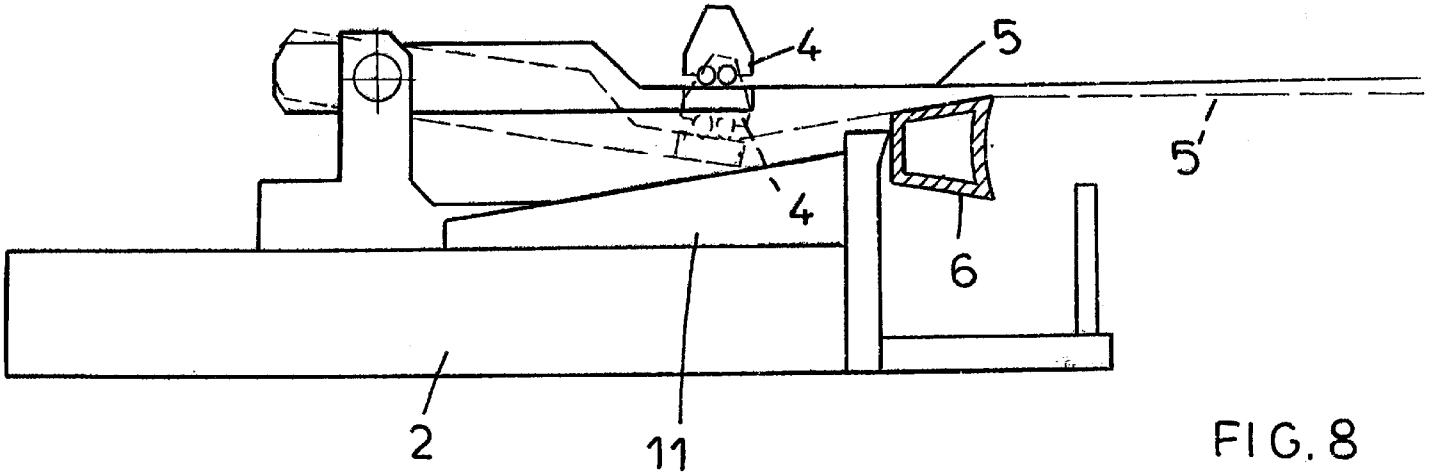
FIGS. 8 and 9 are schematic diagrams, illustrating the two operating cases of minimum and maximum tensioning stroke of the gripper according to the invention.
Figure 9:
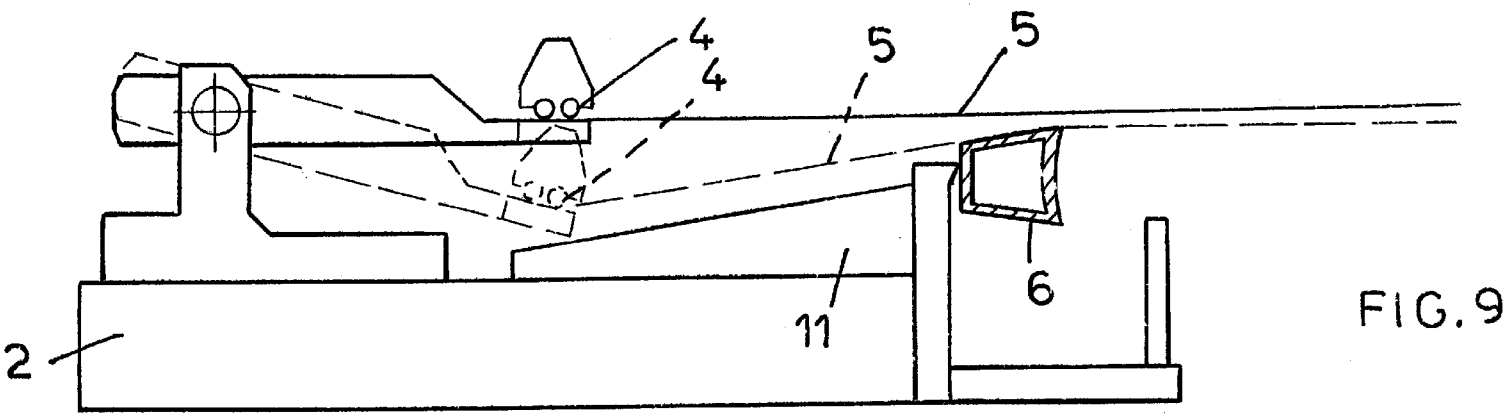

FIG. 2 shows the driving mechanism of the gripper and the smallest and largest frames the gripper can be fitted to, to demonstrate, for all said frame sizes, the proper supporting of the fabric material.

By way of a merely exemplary illustration, some designing data of an industrial embodiment of the gripper according to the present invention are hereinbelow provided:

maximum designing tension: 55 N/cm maximum tensioning or stretching stroke: 140 mm width of the gripper jaws: 250 mm (150 mm)

closing of the gripper jaws: Manual (three-hinge arch)

main cylinder boring: 54 mm mass: about 10 kg.

It has been found that the invention fully achieves the intended aim and objects.

In fact, the invention provides a screen printing pneumatic gripper, of a dual-movement type, in which the lowering stroke is non constant but can be changed (being mechanically limited) and being designed for assuming higher values for greater tensioning or stretching strokes, to cause the fabric material to be lowered with a sufficient angle to provide, in all cases, a proper bearing of the fabric material even on tapering cross-section screen printing frames.

Likewise, owing to the additional travel provided by the system during the lowering operation, any excessive frame/fabric spacing (which would negatively affect the stability of the gripper) is prevented.

Finally, since the additional lowering movement is obtained by an additional rotation and not by an inclined pulling axis, the problem of an unproper contact of the fabric and screen printing frame is fully obviated.

In practicing the invention, the used materials, as well as the size and shapes of the elements forming the subject device, could be any, depending on the requirements and the status of the art.

What is claimed is:

1. A screen printing gripper comprising a screen printing gripper body supporting a gripping and tensioning assembly supporting, in turn, a gripping element to grip an edge portion of a fabric material to be tensioned on a frame, wherein said screen printing gripper further comprises a pneumatic device for lowering said gripping and tensioning assembly and a bottom abutment cam operating as an end of stroke element for a bearing foot element rigid with said gripping and tensioning assembly, said abutment cam being designed for providing a variable lowering stroke of said gripping and tensioning assembly depending on a withdrawn stroke of said gripping element, to provide a variable lowering movement of said gripping and tensioning assembly varying depending on a tensioning stroke of said fabric material, said lowering movement comprising a main lowering movement and an additional rotary lowering movement.

2. A gripper according to claim 1, wherein said gripper body comprises a supporting element for supporting said frame and a safety limit pin therefore, said supporting element supporting said frame independently from said limit pin.

* * * * *

UNITED STATES PATENT AND TRADEMARK OFFICE

CERTIFICATE OF CORRECTION

PATENT NO. : 6,722,274 B1
DATED : August 3, 2004
INVENTOR(S) : Petro Estakhri

It is certified that error appears in the above-identified patent and that said Letters Patent is hereby corrected as shown below:

Title page,
Item [57], ABSTRACT, delete "mappmg" and insert -- mapping --.

Column 2,
Lines 19-21, delete "Not only does the erase operation entail erasing the typical flash memory cell but additionally can results in the overerasure of the typical flash memory cell." and insert -- Not only does the erase operation entail erasing the typical flash memory cell but additionally requires programming the typical flash memory cell for the erase operation before executing the erase operation. As such, the cell is first programmed to a high threshold voltage. Electrical erase pulses are then applied to the memory cell to remove the stored charges. Failure to program the typical flash memory cell for the erase operation can result in the overerasure of the typical flash memory cell by dislodging bound electrons in the floating gate and driving them away. When the floating gate becomes deplete in this manner, the typical flash memory cell can no longer properly operate. --.

Column 3,
Line 54, delete "1 12" and insert -- 112 --.

Column 13,
Line 31, delete ", 422. in each" and insert -- , 422 in each --.

Signed and Sealed this

Twelfth Day of October, 2004

JON W. DUDAS
*Director of the United States Patent and Trademark Office*

UNITED STATES PATENT AND TRADEMARK OFFICE

CERTIFICATE OF CORRECTION

PATENT NO. : 6,722,274 B1
DATED : August 3, 2004
INVENTOR(S) : Petro Estakhri

It is certified that error appears in the above-identified patent and that said Letters Patent is hereby corrected as shown below:

Title page,
Item [57], ABSTRACT, delete "mappmg" and insert -- mapping --.

Column 2,
Lines 19-21, delete "Not only does the erase operation entail erasing the typical flash memory cell but additionally can results in the overerasure of the typical flash memory cell." and insert -- Not only does the erase operation entail erasing the typical flash memory cell but additionally requires programming the typical flash memory cell for the erase operation before executing the erase operation. As such, the cell is first programmed to a high threshold voltage. Electrical erase pulses are then applied to the memory cell to remove the stored charges. Failure to program the typical flash memory cell for the erase operation can result in the overerasure of the typical flash memory cell by dislodging bound electrons in the floating gate and driving them away. When the floating gate becomes deplete in this manner, the typical flash memory cell can no longer properly operate. --.

Column 3,
Line 54, delete "1 12" and insert -- 112 --.

Column 13,
Line 31, delete ", 422. in each" and insert -- , 422 in each --.

Signed and Sealed this

Ninth Day of November, 2004

JON W. DUDAS
*Director of the United States Patent and Trademark Office*

UNITED STATES PATENT AND TRADEMARK OFFICE

CERTIFICATE OF CORRECTION

PATENT NO. : 6,722,274 B2
DATED : April 20, 2004
INVENTOR(S) : Marco Mietta

It is certified that error appears in the above-identified patent and that said Letters Patent is hereby corrected as shown below:

This certificate supersedes Certificate of Correction issued October 12, 2004, the number was erroneously mentioned and should be vacated since no Certificate of Correction was granted.

Signed and Sealed this

Twenty-third Day of November, 2004

JON W. DUDAS
*Director of the United States Patent and Trademark Office*